US009989882B2

(12) United States Patent
Shima et al.

(10) Patent No.: US 9,989,882 B2
(45) Date of Patent: Jun. 5, 2018

(54) DEVELOPMENT DEVICE AND IMAGE FORMING APPARATUS

(71) Applicant: KONICA MINOLTA, INC., Chiyoda-ku, Tokyo (JP)

(72) Inventors: Toshiaki Shima, Sanda (JP); Masanori Kawada, Toyokawa (JP); Yohei Ito, Toyokawa (JP); Shinya Tokutake, Toyokawa (JP); Hiroaki Umemoto, Neyagawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days. days.

(21) Appl. No.: 15/427,385

(22) Filed: Feb. 8, 2017

(65) Prior Publication Data

US 2017/0235248 A1 Aug. 17, 2017

(30) Foreign Application Priority Data

Feb. 16, 2016 (JP) ..... 2016-026851

(51) Int. Cl.
*G03G 15/08* (2006.01)
*G03G 15/09* (2006.01)

(52) U.S. Cl.
CPC ..... *G03G 15/0812* (2013.01); *G03G 15/0921* (2013.01); *G03G 15/0928* (2013.01)

(58) Field of Classification Search
CPC ..... G03G 15/0812; G03G 15/0928
USPC ..... 399/272
See application file for complete search history.

(56) References Cited

U.S. PATENT DOCUMENTS

2014/0023408 A1* 1/2014 Kato ..... G03G 15/0928 399/269
2017/0060023 A1* 3/2017 Takahashi ..... G03G 15/08

FOREIGN PATENT DOCUMENTS

JP 2013200547 A 10/2013
JP 2015222317 A 12/2015

* cited by examiner

*Primary Examiner* — Walter L Lindsay, Jr.
*Assistant Examiner* — Arlene Heredia Ocasio
(74) *Attorney, Agent, or Firm* — Holtz, Holtz & Volek PC

(57) ABSTRACT

A development device includes: a developer carrier including a magnet roller and a sleeve around the magnet roller; and a restriction member provided opposed to the sleeve surface. When a region on the surface opposed to the restriction member is defined as a first region and regions adjacent to the first region are defined as second and third regions, a magnetic flux density is largest in the second region. When a position where the density is largest in the second region is defined as a reference position, a position where the density is a predetermined value in the second region is defined as a downstream position, and a position where the density is the predetermined value in the third region is defined as an upstream position, the width between the reference position and the upstream position is longer than the width between the reference position and the downstream position.

12 Claims, 10 Drawing Sheets

DEVELOPMENT DEVICE AND IMAGE FORMING APPARATUS

This application is based on Japanese Patent Application No. 2016-026851 filed with the Japan Patent Office on Feb. 16, 2016, the entire content of which is hereby incorporated by reference.

BACKGROUND OF THE INVENTION

Field of the Invention

The present disclosure relates to a development device and an image forming apparatus, and more particularly to a development device and an image forming apparatus for forming an image by electrophotography.

Description of the Related Art

Electrophotographic image forming apparatuses are widely used. An electrophotographic image forming apparatus includes a development device. The development device supplies developer to the photoconductor to develop an electrostatic latent image formed on the photoconductor.

Referring to FIG. 10, a development device 50X included in an image forming apparatus will be described. FIG. 10 is a diagram showing the internal structure of development device 50X. As shown in FIG. 10, development device 50X includes a restriction member 56 for regulating the amount of developer conveyed and a developer carrier 60 for carrying the developer. Developer carrier 60 includes a fixed magnet roller 52 and a sleeve 53 provided rotatably on the surface of magnet roller 52 to convey the developer downstream in the rotation direction.

The developer is composed of toner and carrier. Toner and carrier are stirred in the inside of development device 50X to produce static electricity. The charged developer is attracted to magnet roller 52 and adheres to sleeve 53. Developer carrier 60 allows sleeve 53 to rotate to convey the developer adhering to sleeve 53 to restriction member 56. The developer is leveled off when passing through restriction member 56. The amount of developer conveyed thus becomes uniform.

The amount of developer conveyed may vary with various factors. If the amount of developer conveyed varies, the print quality is degraded. It is therefore desired to equalize the amount of developer conveyed. In connection with the technique for suppressing variation of the amount of developer conveyed, for example, Japanese Laid-Open Patent Publication No. 2013-200547 discloses a development device that "suppresses variation of the amount of developer conveyed over time and stabilizes the image density".

The developer adhering to the surface of sleeve 53 is affected by the magnetic force by magnet roller 52. In FIG. 10, the magnitude of magnetic force received by the developer from magnet roller 52 is depicted as magnetic line of force X. The developer receiving magnetic force from magnet roller 52 is in a continuous state in the direction of magnetic force on sleeve 53. The conveyed developer then comes into contact with restriction member 56 and is leveled off by restriction member 56.

When the magnetic force exerted on the developer in the vicinity of restriction member 56 is too large, excessive force is exerted on the developer and degrades the developer. On the other hand, when the magnetic force exerted on the developer in the vicinity of restriction member 56 is too small, development device 50X fails to stabilize the amount of developer conveyed. It is therefore important to stabilize the magnetic force exerted on the developer in the vicinity of restriction member 56.

The development device disclosed in Japanese Laid-Open Patent Publication No. 2013-200547 forms symmetrical magnetic line of force X on sleeve 53. Therefore, the inclination of magnetic line of force X in the vicinity of restriction member 56 increases. As a result, slight displacement of magnet roller 52 causes variation of magnetic force in restriction member 56 more than expected. The development device disclosed in Japanese Laid-Open Patent Publication No. 2013-200547 therefore fails to stabilize the amount of developer conveyed.

SUMMARY OF THE INVENTION

The present disclosure is made to solve the aforementioned problem. An object in an aspect is to provide a development device capable of stabilizing the amount of developer conveyed more than in conventional examples. An object in another aspect is to provide an image forming apparatus capable of stabilizing the amount of developer conveyed more than in conventional examples.

According to an aspect, a development device includes a supply mechanism configured to supply developer and a developer carrier configured to carry the developer supplied from the supply mechanism. The developer carrier includes a magnet member configured to attract the developer and a sleeve provided rotatably around the magnet member to convey the developer downstream in a rotation direction. The development device further includes a restriction member provided to be opposed to a surface of the sleeve. When a region on the surface of the sleeve opposed to the restriction member is defined as a first region, a surface region adjacent to the first region and extending to a portion where magnetic flux density is zero downstream in the rotation direction of the sleeve is defined as a second region, and a surface region adjacent to the first region and extending to a portion where magnetic flux density is zero upstream in the rotation direction of the sleeve is defined as a third region, magnetic flux density by the magnet member in the first to third regions is the largest in the second region. When a position where the magnetic flux density is the largest in the second region is defined as a reference position, a position where the magnetic flux density is a predetermined value in the second region downstream from the reference position in the rotation direction of the sleeve is defined as a downstream position, and a position where the magnetic flux density is the predetermined value in the third region is defined as an upstream position, a width between the reference position and the upstream position is longer than a width between the reference position and the downstream position.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention will be described below with reference to the drawings. In the following description, the same parts and components are denoted by the same reference signs. Their designations and functions are also the same and therefore a detailed description thereof will not be repeated. The embodiments and modifications described below may be selectively combined as appropriate.

[Internal Structure of Image Forming Apparatus 100]

Figure 1:
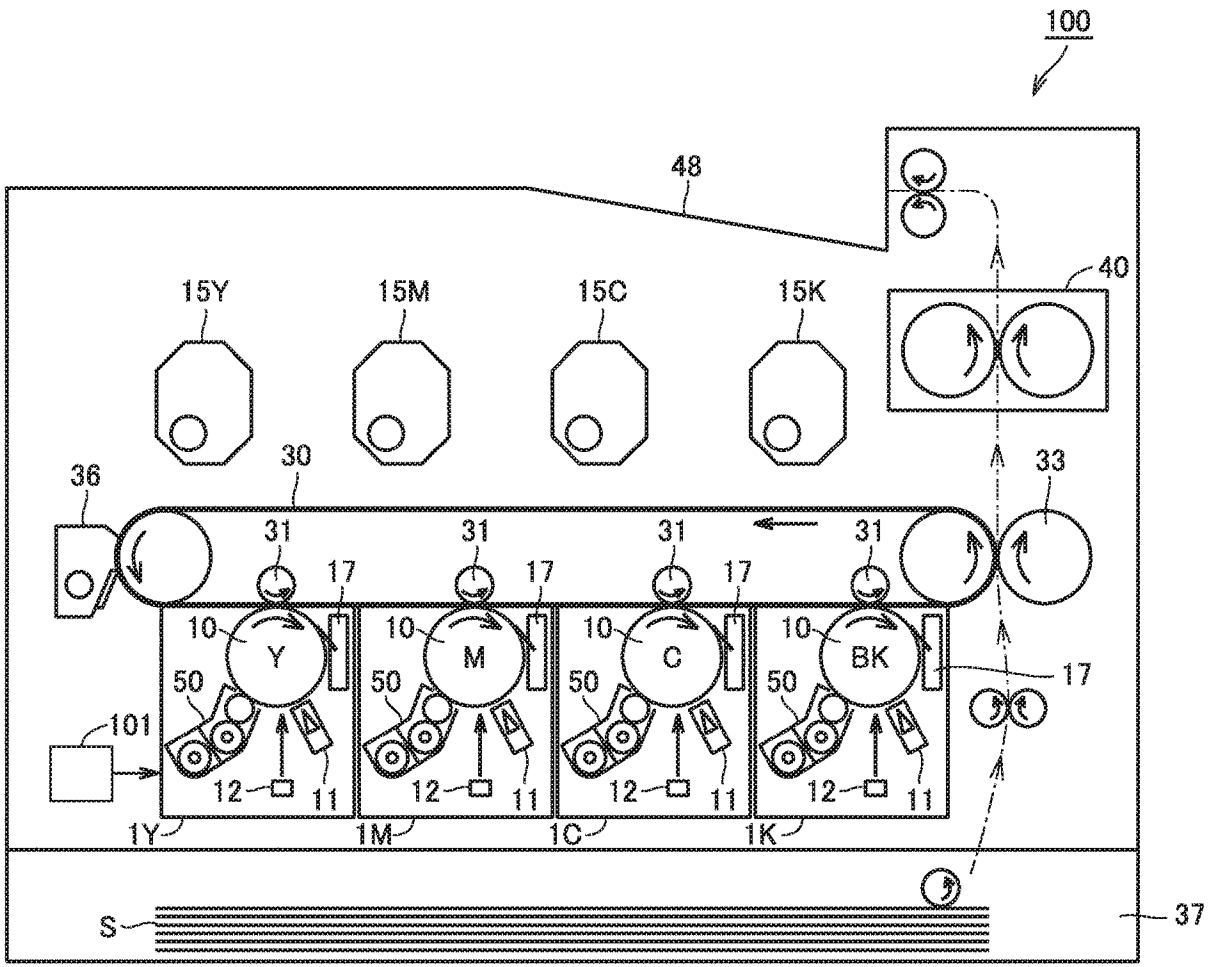
FIG. 1 is a diagram showing an example of the apparatus configuration of an image forming apparatus according to an embodiment.

Referring to FIG. 1, an image forming apparatus 100 according to an embodiment will be described. FIG. 1 is a diagram showing an example of the apparatus configuration of image forming apparatus 100.

FIG. 1 illustrates image forming apparatus 100 as a color printer. Although image forming apparatus 100 will be described as a color printer below, image forming apparatus 100 is not limited to a color printer. For example, image forming apparatus 100 may be a monochrome printer, a facsimile machine, or an MFP (Multi-Functional Peripheral) that combines a monochrome printer, a color printer, and a facsimile machine.

Image forming apparatus 100 includes image forming units 1Y, 1M, 1C, 1K, an intermediate transfer belt 30, a primary transfer roller 31, a secondary transfer roller 33, a cleaning device 36, a cassette 37, a fixing device 40, and a control device 101.

Image forming unit 1Y is supplied with toner from a toner bottle 15Y to form a toner image of yellow (Y). Image forming unit 1M is supplied with toner from a toner bottle 15M to form a toner image of magenta (M). Image forming unit 1C is supplied with toner from a toner bottle 15C to form a toner image of cyan (C). Image forming unit 1K is supplied with toner from a toner bottle 15K to form a toner image of black (BK).

Image forming units 1Y, 1M, 1C, 1K are arranged in order along the rotation direction of intermediate transfer belt 30. Image forming units 1Y, 1M, 1C, 1K each include a photoconductor 10, a charging device 11, an exposure device 12, a cleaning device 17, and a development device 50.

Photoconductor 10 is an image carrier that carries a toner image. As an example, photoconductor 10 is shaped like a drum. On the surface of photoconductor 10, a photosensitive layer is formed. Charging device 11 uniformly charges the surface of photoconductor 10. Exposure device 12 emits laser radiation to photoconductor 10 in response to a control signal from control device 101 and exposes the surface of photoconductor 10 in accordance with a specified image pattern. An electrostatic latent image corresponding to an input image is thus formed on photoconductor 10. The electrostatic latent image formed on photoconductor 10 is developed as a toner image by development device 50. The details of development device 50 will be described later.

Photoconductor 10 and intermediate transfer belt 30 are in contact with each other at a section where primary transfer roller 31 is provided. Transfer bias applied to this contact section causes the toner image developed on photoconductor 10 to be transferred onto intermediate transfer belt 30. Here, the toner image of yellow (Y), the toner image of magenta (M), the toner image of cyan (C), and the toner image of black (BK) are superimposed in order and transferred to intermediate transfer belt 30. A color toner image is thus formed on intermediate transfer belt 30.

Cleaning device 17 includes a cleaning blade. The cleaning blade is pressed against photoconductor 10 to collect toner left on the surface of photoconductor 10 after transfer of the toner image.

Cassette 37 is loaded with paper S. Paper S is sent sheet by sheet from cassette 37 to secondary transfer roller 33. Secondary transfer roller 33 transfers the toner image transferred on intermediate transfer belt 30 onto paper S. The timing of outputting and conveying paper S is synchronized with the position of the toner image on intermediate transfer belt 30 to transfer the toner image onto the appropriate position of paper S. Subsequently, paper S is sent to fixing device 40.

Fixing device 40 presses and heats paper S. The toner image is thus fused on paper S and fixed on paper S. Subsequently, paper S is discharged to a tray 48.

Cleaning device 36 includes a cleaning blade. The cleaning blade is pressed against intermediate transfer belt 30 and collects toner left on intermediate transfer belt 30 after transfer of the toner image. The collected toner is conveyed by a conveyance screw (not shown) and stored in a toner waste container (not shown).

Control device 101 controls, for example, a motor (not shown) for driving the rotation of developer carrier 60 in development device 50 to regulate the amount of developer supplied from development device 50 to photoconductor 10.

The structure of image forming apparatus 100 is not limited to the example shown in FIG. 1. For example, image forming apparatus 100 may include a single photoconductor 10 and a plurality of development devices 50 configured to be rotatable. In this case, image forming apparatus 100 allows each development device 50 to rotate to guide each development device 50 to photoconductor 10 in order. The toner image of each color is thus developed on photoconductor 10 to form a color image.

[Internal Structure of Development Device 50]

Figure 2:
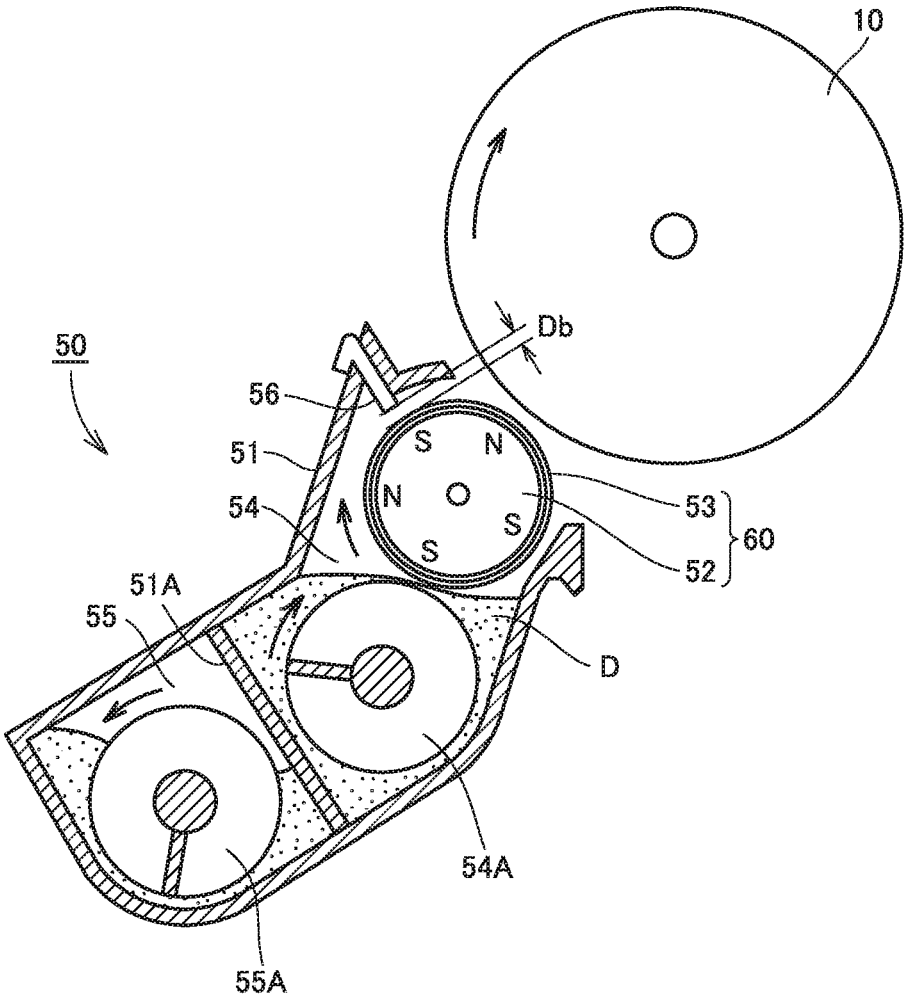
FIG. 2 is a diagram showing the internal structure of a development device according to an embodiment.

Referring to FIG. 2, development device 50 shown in FIG. 1 will be described. FIG. 2 is a diagram showing the internal structure of development device 50.

As shown in FIG. 2, development device 50 includes a housing 51. In the inside of housing 51, a partition wall 51A, a first agitating member 54A, a second agitating member 55A, and a developer carrier 60 are provided.

Partition wall 51A is provided along the axial direction of developer carrier 60. The interior of housing 51 is separated by partition wall 51A into a first conveyance portion 54 and a second conveyance portion 55. In the interior of first conveyance portion 54 and second conveyance portion 55, developer D is accommodated. Developer D is composed of toner and magnetic carrier.

In the interior of first conveyance portion 54, a first agitating member 54A is provided to serve as a supply mechanism for developer D. First agitating member 54A conveys developer D from first conveyance portion 54 to second conveyance portion 55 while agitating developer D. In the interior of second conveyance portion 55, a second agitating member 55A is provided to serve as a supply mechanism for developer D. Second agitating member 55A conveys developer D to developer carrier 60 while agitating developer D. First agitating member 54A and second agitating member 55A rotate in opposite directions to circulate developer D between first conveyance portion 54 and second conveyance portion 55 through circulation ports (not shown) provided at both ends of partition wall 51A.

Developer carrier 60 is provided to be opposed to photoconductor 10 at a predetermined distance from photoconductor 10. Developer carrier 60 is configured with a magnet roller 52 (magnet member) for attracting developer D and a sleeve 53 provided rotatably around magnet roller 52 to convey developer D downstream in the rotation direction.

On the surface of magnet roller 52, the south pole and the north pole are disposed. The south pole opposed to first agitating member 54A may hereinafter be referred to as "catch pole". The north pole adjacent to the catch pole may be referred to as "conveyance pole". The south pole adjacent to the conveyance pole may be referred to as "restriction pole". The north pole adjacent to the restriction pole may be referred to as "main pole". The south pole adjacent to the main pole may be referred to as "sealing pole".

Developer D is agitated to produce static electricity and is then charged. The charged developer D is attracted to the catch pole (south pole) to adhere to sleeve 53. Subsequently, developer D on sleeve 53 is conveyed to the conveyance pole (north pole). Developer D is kept adhering to sleeve 53 by conveyance pole (north pole).

Housing 51 of development device 50 is provided with a restriction member 56 for regulating the amount of developer D conveyed. One end of restriction member 56 is fixed to housing 51. Restriction member 56 is, for example, shaped like a plate and is disposed such that the plate surface is orthogonal to the rotation surface of sleeve 53. Restriction member 56 is provided to be opposed to the surface of sleeve 53 of developer carrier 60. More specifically, restriction member 56 is provided at a section opposed to the restriction pole (south pole) of magnet roller 52 at a distance Db from sleeve 53. Developer D receives magnetic force from the restriction pole (south pole) to become continuous in the vertical direction toward photoconductor 10 on the surface of sleeve 53. Developer D is thus leveled off by restriction member 56 so that the amount of developer D conveyed becomes uniform.

Preferably, restriction member 56 is formed of a magnetic substance. A magnetic field is thus formed between restriction member 56 and developer carrier 60 to exert magnetic suction three on the surface of restriction member 56. As a result, developer D is leveled off more easily.

After passing through the restriction pole (south pole), developer D is conveyed to the main pole (north pole). Developer D receives magnetic force from the main pole (north pole) to become continuous in the direction of magnetic force. Since the toner included in developer D is charged to the positive polarity, the carrier included in developer D is charged to the negative polarity, and the electrostatic latent image formed on photoconductor 10 is charged to the negative polarity, the toner alone adheres to photoconductor 10. The electrostatic latent image formed on photoconductor 10 is thus developed as a toner image. Subsequently, developer D left on sleeve 53 is conveyed to the sealing pole (south pole) of magnet roller 52.

Although restriction member 56 is shaped like a plate in the example described above, restriction member 56 is not limited to a plate-like shape. For example, restriction member 56 may be shaped like a rod. In this case, restriction member 56 is provided along the direction of rotation axis of developer carrier 60.

[Magnetic Flux Density]

Figure 3:
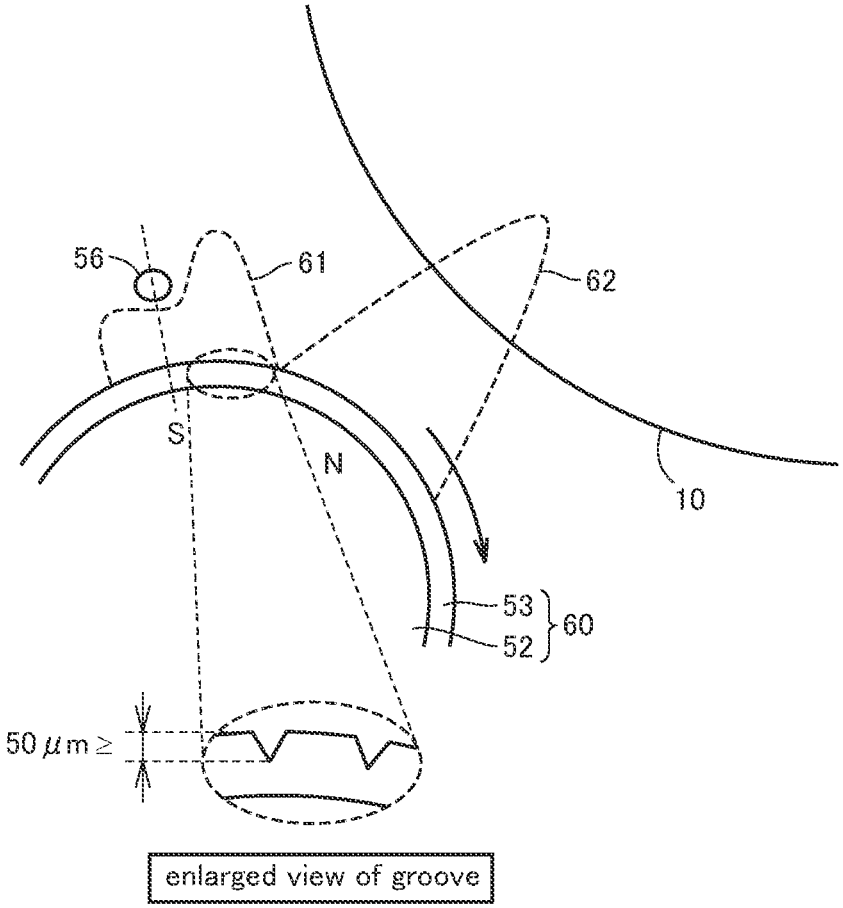
FIG. 3 is a diagram schematically showing the magnetic flux density on the developer carrier.

Referring to FIG. 3, the distribution of magnetic flux on developer carrier 60 will be described. FIG. 3 is a diagram schematically showing the magnetic flux density on developer carrier 60. Since the magnetic flux density and the magnetic force are correlated to each other, "magnetic flux density" hereinafter may be referred to as "magnetic three", and "magnetic force" may be referred to as "magnetic flux density".

As described above, the south pole and the north pole are disposed on the surface of magnet roller 52. In FIG. 3, the magnitude of magnetic force received from the restriction pole (south pole) is denoted as magnetic line of force 61. The magnitude of magnetic force received from the main pole (north pole) is denoted as magnetic line of force 62.

The developer conveyed on sleeve 53 receives magnetic force from the restriction pole (south pole) to become continuous in the direction of magnetic force on sleeve 53. The developer conveyed on sleeve 53 is thus leveled off by restriction member 56.

Subsequently, the developer is conveyed to the main pole (north pole). The developer conveyed on sleeve 53 receives magnetic force from the main pole (north pole) to be continuous in the vertical direction toward photoconductor 10 on the surface of sleeve 53. The developer thus comes into contact with photoconductor 10 to move from sleeve 53 to photoconductor 10.

Figure 4:
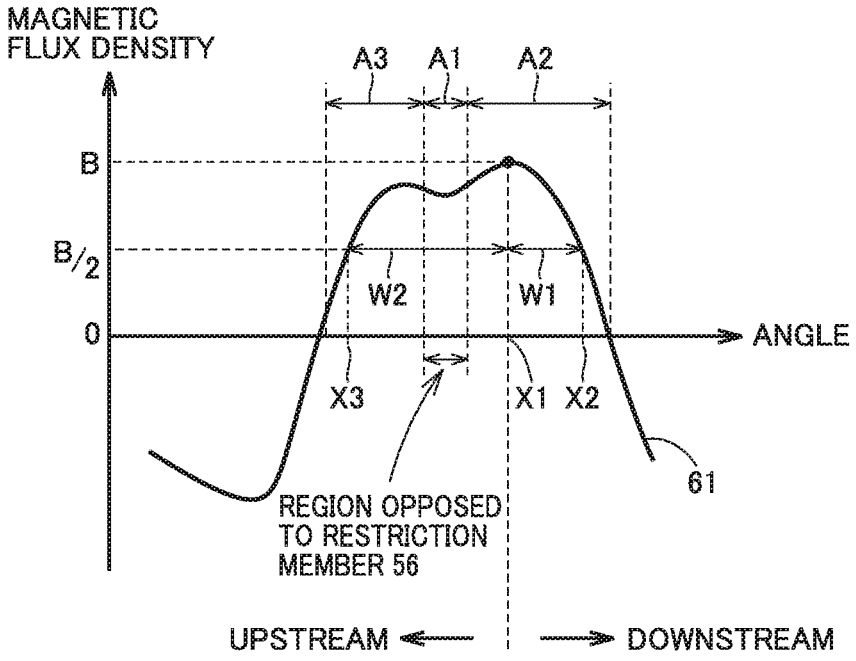
FIG. 4 is a diagram showing a graph representing the magnetic flux density on the sleeve.

Referring to FIG. 4, the magnetic line of force 61 formed in the vicinity of restriction member 56 will be further explained. FIG. 4 is a diagram showing a graph representing the magnetic flux density on sleeve 53.

The horizontal axis of the graph shown in FIG. 4 represents an angle in the polar coordinate system where the center of rotation of sleeve 53 is the origin. That is, the horizontal axis of the graph shown in FIG. 4 represents a position on the surface of sleeve 53. The vertical axis of the graph shown in FIG. 4 represents the magnitude of magnetic flux density on sleeve 53.

In the following, a region on the surface of sleeve 53 opposed to restriction member 56 is defined as region A1 (first region). A surface region that is adjacent to region A1 and extends to the portion where the magnetic flux density is zero downstream in the rotation direction of sleeve 53 is defined as region A2 (second region). A surface region that is adjacent to region A1 and extends to the portion where the magnetic flux density is zero upstream in the rotation direction of sleeve 53 is defined as region A3 (third region). That is, region A2 and region A3 are located on the opposite sides with region A1 interposed therebetween.

As shown in FIG. 4, the magnetic flux density by magnet roller 52 in regions A1 to A3 is the largest at region A2. This produces the following effects. The developer conveyed through region A1 may be attracted by magnetic line of force 62 (see FIG. 3) formed by the main pole (north pole) to slip from region A1 to the downstream side on the surface of sleeve 53 (so called developer peeling). When the magnetic flux density at region A2 is high, the force keeping the developer increases at region A2 to prevent slippage of the developer. This effect is particularly significant when the amount of developer conveyed is small or when the friction coefficient of sleeve 53 is low.

In the following, the position where the magnetic flux density is the largest in region A2 is defined as reference position X1. The position where the magnetic flux density is a predetermined value (which may be hereinafter referred to as "reference value") in region A2 downstream from reference position X1 in the rotation direction of sleeve 53 is defined as downstream position X2. The reference value is smaller than the maximum value of magnetic flux density in region A2. The position where the magnetic flux density is the reference value in region A3 is defined as upstream position X3.

Here, width W2 between reference position X1 and upstream position X3 is longer than width W1 between reference position X1 and downstream position X2. Thus, the inclination of magnetic line of force 61 in region A1 is lower than the inclination of magnetic line of force 61 in region A2. Therefore, even when magnet roller 52 or restriction member 56 is displaced, the magnetic flux density in region A2 hardly changes. The amount of developer conveyed is thus stabilized.

Preferably, the reference value of magnetic flux density for determining widths W1, W2 is half of the maximum value of magnetic flux density in region A2. That is, widths W1, W2 correspond to the half-width of the maximum value of magnetic flux density in region A2. The reference value is not limited to half of the maximum value of magnetic flux density in region A2. For example, the reference value may be ¼ of the maximum value of magnetic flux density in region A2.

Further preferably, the magnetic flux density in region A1 is the smallest at a portion other than the end portions of region A1. More specifically, the magnetic flux density in region A1 is the smallest at a portion other than one end of region A1 on the region A2 side and the other end of region A1 on the region A3 side. Thus, the shape of magnetic line of force 61 in region A1 is protruding downward. Therefore, the inclination of magnetic line of force 61 in region A1 is decreased, which can further stabilize the magnetic flux density in region A2.

Further preferably, the minimum value of magnetic flux density in region A1 is smaller than the maximum value of magnetic flux density in region A2 and smaller than the maximum value of magnetic flux density in region A3. Thus, the inclination of magnetic line of force 61 in region A1 is further decreased and the magnetic flux density in region A2 can be further stabilized. The magnetic flux density in region A1 may be equal to at least one of the maximum value of magnetic flux density in region A2 and the maximum value of magnetic flux density in region A3.

As an example, the maximum value of magnetic flux density in region A1 is 35 mT. The maximum value of magnetic flux density in region A2 is, tor example, 40 mT. The maximum value of magnetic flux density in region A3 is, for example, 37 mT. Preferably, the magnetic flux density of the restriction pole (south pole) regions A1 to A3 is smaller than the magnetic flux density of the main pole (north pole). The maximum value of magnetic flux density of the main pole (north pole) is, for example, 105 mT.

[Comparison Result]

Figure 5:
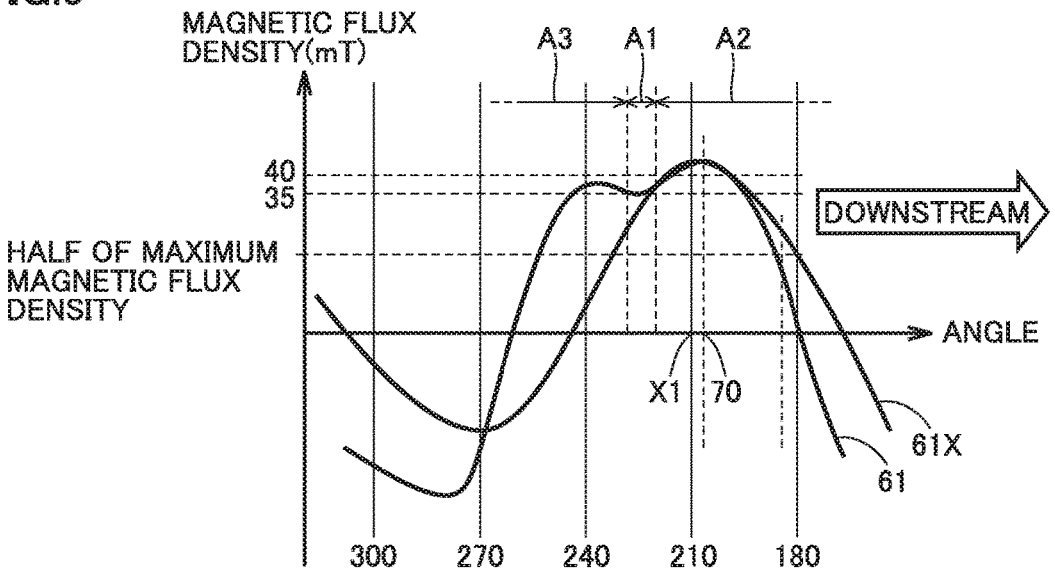
FIG. 5 is a diagram showing the magnetic line of force in the embodiment and the magnetic line of three in a comparative example.
Figure 6:
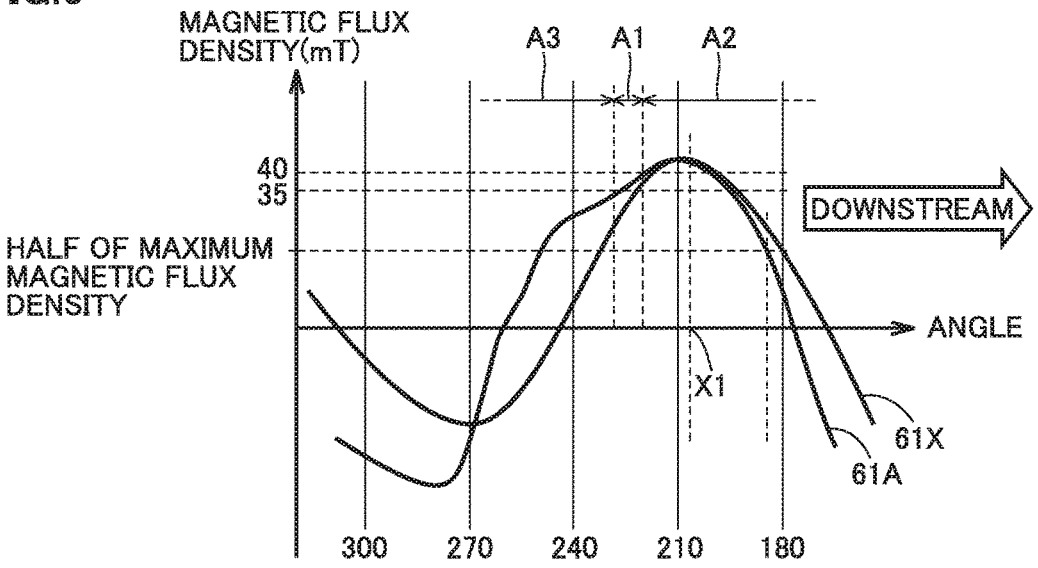
FIG. 6 is a diagram showing the magnetic line of force according to a first modification and the magnetic line of force according to the comparative example.
Figure 7:
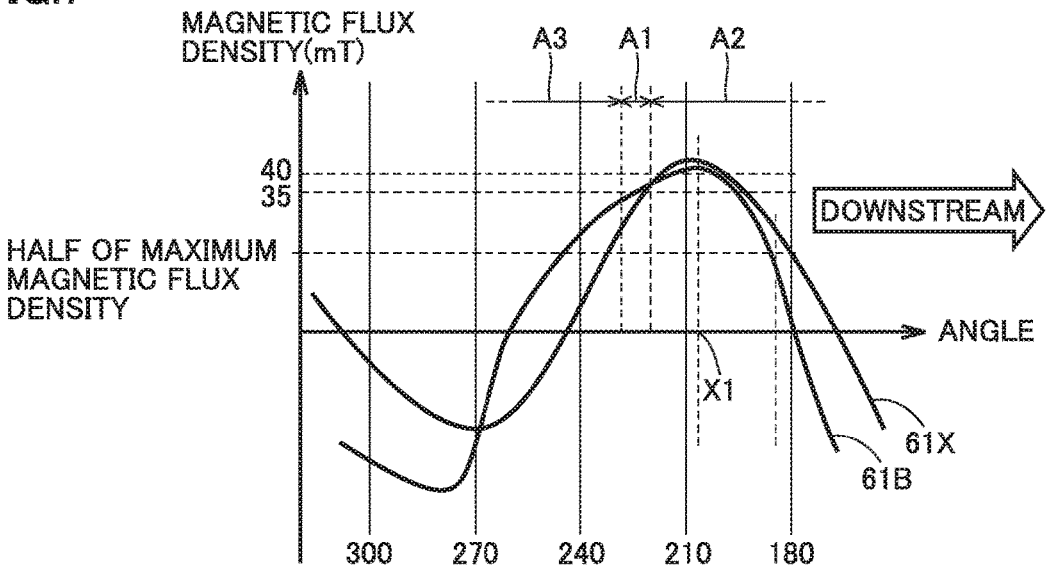
FIG. 7 is a diagram showing the magnetic line of force according to a second modification and the magnetic line of force according to the comparative example.

Referring to FIG. 5 to FIG. 7, development device 50 according to the embodiment will be compared with the development device according to a comparative example. FIG. 5 is a diagram showing magnetic line of force 61 in the embodiment and magnetic line of force 61X in the comparative example.

In the following, the surface on sleeve 53 opposed to restriction member 56 is defined as region A1, in the same manner as in FIG. 4. A surface region that is adjacent to region A1 and downstream in the rotation direction of sleeve 53 is defined as region A2. A surface region that is adjacent to region A1 and upstream in the rotation direction of sleeve 53 is defined as region A3.

As shown in FIG. 5, although the shape of magnetic line of force 61 in region A2 is almost the same as magnetic line of force 61X, the shape of magnetic line of force 61 in regions A1, A3 differs from magnetic line of force 61X. The inclination of magnetic line of force 61 in region A1 is lower than magnetic line of force 61X. Therefore, in development device 50 according to the embodiment, even when magnet roller 52 is displaced, the magnetic flux density in region A2 hardly changes. Development device 50 therefore can stabilize the amount of developer conveyed.

As an example, as shown by magnetic line of force 61, the maximum value of magnetic flux density in region A2 is equal to or greater than 40 mT. The maximum value of magnetic flux density in region A1 is smaller than 40 mT.

The shape of magnetic line of force 61 is not limited to the example shown in FIG. 5 as long as the inclination of magnetic line of force 61 in region A1 is lower than the inclination of magnetic line of force 61X according to the comparative example. Examples of the modification to magnetic line of force 61 include magnetic line of force 61A shown in FIG. 6 and magnetic line of force 61B shown in FIG. 7. FIG. 6 is a diagram showing magnetic line of force 61A according to a first modification and magnetic line of force 61X according to the comparative example. FIG. 7 is a diagram showing magnetic line of force 61B according to a second modification and magnetic line of force 61X according to the comparative example.

As shown in FIG. 6, magnetic line of force 61X in the comparative example is symmetric with respect to reference position X1 where the magnetic flux density is the largest. That is, in magnetic line of force 61X, the half-width of magnetic flux density with reference to reference position X1 is equal between the upstream side and the downstream side. By contrast, in magnetic line of force 61A according to the first modification, the half-width of magnetic flux density with reference to reference position X1 is longer on the upstream side than on the downstream side. Therefore, the inclination of magnetic line of force 61A in region A1 is lower than magnetic line of force 61X according to the comparative example. As a result, development device 50 according to the first modification can stabilize the amount of developer conveyed in region A2 more than the development device according to the comparative example.

Similarly, as shown in FIG. 7, in magnetic line of force 61B according to the second modification, the half-width of magnetic flux density with reference to reference position X1 is longer on the upstream side than on the downstream side. Therefore, the inclination of magnetic line of force 61A in region A1 is lower than magnetic line of force 61X according to the comparative example. Accordingly, development device 50 according to the second modification can stabilize the amount of developer conveyed in region A2 more than the development device according to the comparative example.

Magnetic line of force 61A according to the first modification has a shape protruding downward in region A1, unlike magnetic line of force 61B according to the second modification. Therefore, development device 50 according to the first modification can stabilize the amount of developer conveyed in region A2 more than development device 50 according to the second modification.

In magnetic line of force 61 according to the embodiment, the inclination of magnetic line of force 61 is almost zero in region A1, and the inclination of magnetic line of force 61 in region A1 is further lower than magnetic line of force 61A according to the first modification. Therefore, development device 50 according to the embodiment can further stabilize the amount of developer conveyed in region A2 more than development device 50 according to the first modification.

[Groove Formed on Developer Carrier 60]

Figure 8:
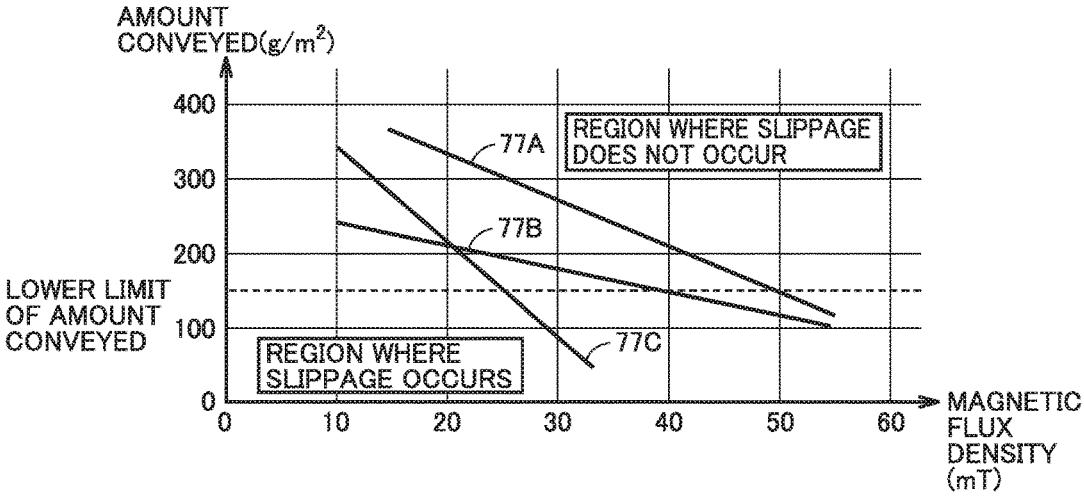
FIG. 8 is a diagram showing the relation between the magnetic flux density in a region A2 on the sleeve and the amount of developer conveyed on the sleeve.

Referring to FIG. 8, the condition for suppressing slippage of developer on sleeve 53 (see FIG. 2) of developer carrier 60 (see FIG. 2) will be described. FIG. 8 is a diagram showing the relation between the magnetic flux density in region A2 (see FIG. 4) on sleeve 53 and the amount of developer conveyed on sleeve 53.

The main causes of slippage of developer are the amount of developer conveyed on sleeve 53, the friction coefficient of sleeve 53, the magnetic force in region A2 on sleeve 53, and the magnetic force of the main pole (north pole). The larger the amount of developer conveyed, the more the slippage of developer is suppressed. The larger the friction coefficient of sleeve 53, the more the slippage of developer is suppressed. The greater the magnetic force in region A2 on sleeve 53, the more the slippage of developer is suppressed. Adjusting the magnetic force of the main pole is not preferable because the magnetic force of the main pole is closely associated with development performance.

One of the methods of increasing the friction coefficient of sleeve 53 is forming a plurality of grooves on the surface of sleeve 53. Preferably, each groove on sleeve 53 is formed along the direction of the rotation axis of sleeve 53. The greater the number of grooves formed is, the greater the friction coefficient of sleeve 53 is. The deeper the formed groove is, the greater the friction coefficient of sleeve 53 is.

FIG. 8 shows border lines 77A to 77C. Border line 77A represents the border of occurrence of slippage when there are 40 grooves on sleeve 53 and each groove has a depth of 30 μm. That is, slippage of developer occurs on the lower left of border line 77A, whereas slippage of developer does not occur on the upper right of border line 77A. When the lower limit of the amount of developer conveyed is 150 g/m$^2$, slippage is suppressed with a magnetic flux density equal to or greater than 50 mT.

Border line 77B represents the border of occurrence of slippage when there are 64 grooves on sleeve 53 and each groove has a depth of 30 μm. That is, slippage of developer occurs on the lower left of border line 77B, whereas slippage of developer does not occur on the upper right of border line 77B. When the lower limit of the amount of developer conveyed is 150 g/m$^2$, slippage is suppressed with a magnetic flux density equal to or greater than 40 mT.

Border line 77C represents the border of occurrence of slippage when there are 40 grooves on sleeve 53 and each groove has a depth of 75 μm. That is, slippage of developer occurs on the left side of border line 77C, whereas slippage of developer does not occur on the right side of border line 77C. When the lower limit of the amount of developer conveyed is 150 g/m$^2$, slippage is suppressed with a magnetic flux density equal to or greater than 25 mT.

In this way, it is necessary to increase the magnetic force in region A2 on sleeve 53 as the friction force on sleeve 53 decreases. That is, it is necessary to increase the magnetic force in region A2 on sleeve 53 as the number of grooves on sleeve 53 decreases and the depth of each groove decreases.

[Conveyance Characteristic of Developer Carrier 60]

Figure 9:
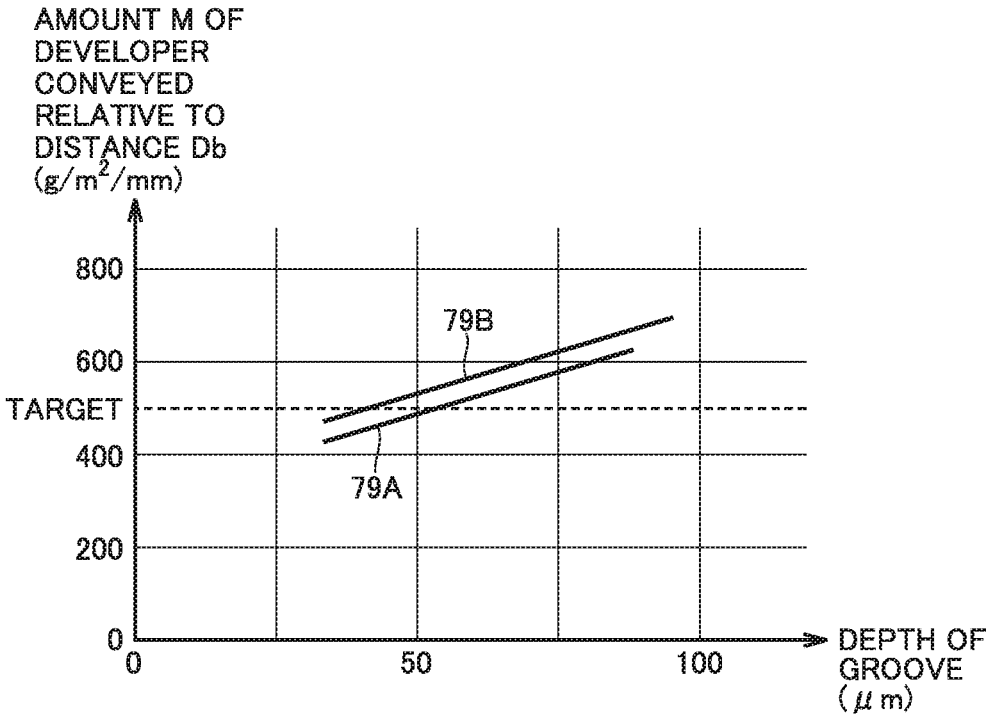
FIG. 9 is a diagram showing the relation between the depth of the groove on the sleeve and the amount of developer conveyed relative to the distance of the restriction member and the sleeve.
Figure 10:
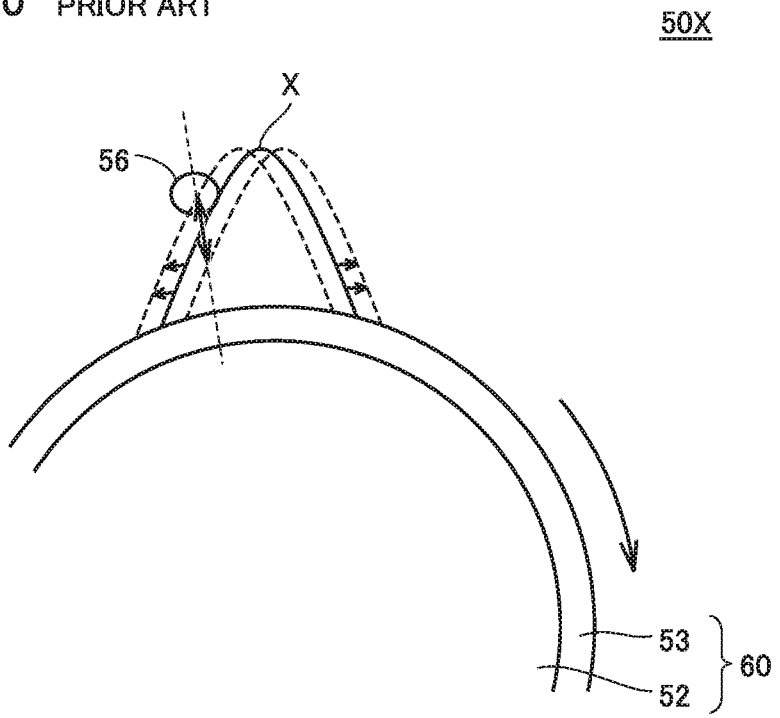
FIG.10 PRIOR ART
FIG. 10 is a diagram showing the internal structure of a development device according to a comparative example.

Referring to FIG. 9, the conveyance characteristic of developer on sleeve 53 (see FIG. 2) having grooves on its surface will be described. FIG. 9 is a diagram showing the relation between the depth of the groove on sleeve 53 and the amount M of developer conveyed relative to distance Db (see FIG. 2) of restriction member 56 (see FIG. 2) and sleeve 53.

To simplify the production steps of development device 50, it is important to eliminate adjustment of parts during assembly of development device 50. In order to do so, it is necessary to reduce the amount M of developer conveyed relative to distance Db of restriction member 56 and sleeve 53. This is because when the conveyed amount M decreases, it is unnecessary to adjust distance Db of restriction member 56 and sleeve 53, and the like. In the following, it is assumed that the target value of the conveyed amount M is 500 g/m$^2$/mm.

FIG. 9 shows graphs 79A, 79B. Graph 79A represents the relation between the depth of each groove and the amount M of developer conveyed relative to distance Db when there are 40 grooves on sleeve 53. As shown by graph 79A, when each groove has a depth of 30 μm, the conveyed amount M is about 400 g/m$^2$/mm. When each groove has a depth of 75 μm, the conveyed amount M is about 600 g/m$^2$/mm.

Graph 79B represents the relation between the depth of each groove and the amount M of developer conveyed relative to distance Db when there are 64 grooves on sleeve 53. As shown by graph 79B, when each groove has a depth of 30 μm, the conveyed amount M is about 450 g/m$^2$/mm. When each groove has a depth of 95 μm, the conveyed amount M is about 750 g/m$^2$/mm.

To reduce the conveyed amount M relative to distance Db, it is preferable to reduce the friction coefficient of sleeve 53. That is, it is preferable to reduce the number of grooves on sleeves 53 and decrease the depth of each groove. As an example, the depth of each groove formed on sleeve 53 is preferably equal to or smaller than 50 μm. With this, the conveyed amount M relative to distance Db of restriction member 56 and sleeve 53 is reduced, and the conveyed amount M for a change in distance Db is stabilized. As a result, it is no longer necessary to adjust the distance Db of restriction member 56 and sleeve 53, and the production steps of development device 50 are simplified.

On the other hand, when the depth of the groove on sleeve 53 is equal to or smaller than 50 μm, the friction coefficient of sleeve 53 decreases and slippage of developer is more likely to occur. However, in development device 50, since the magnetic force in region A2 (see FIG. 4) of sleeve 53 is higher than that in regions A1, A3 (see FIG. 4) as described above, slippage of developer can be suppressed.

[Conclusion]

As described above, the magnetic flux density in region A1 on the surface of sleeve 53 opposed to restriction member 56 is smaller than the maximum value of magnetic flux density in regions A2, A3 adjacent to region A1. Thus, the inclination of magnetic flux density in region A2 is low, and the magnetic flux density in region A2 hardly changes even when magnet roller 52 or restriction member 56 is displaced. Therefore, development device 50 can equalize the amount of developer conveyed through region A2 without being affected by displacement of magnet roller 52 or restriction member 56.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A development device comprising:

a supply mechanism configured to supply developer;

a developer carrier configured to carry the developer supplied from the supply mechanism, the developer carrier including: a magnet member configured to attract the developer, and a sleeve provided rotatably around the magnet member to convey the developer downstream in a rotation direction; and a restriction member provided to be opposed to a surface of the sleeve, wherein:

when a region on the surface of the sleeve opposed to the restriction member is defined as a first region, a surface region adjacent to the first region and extending to a portion where magnetic flux density is zero downstream in the rotation direction of the sleeve is defined as a second region, and a surface region adjacent to the first region and extending to a portion where magnetic flux density is zero upstream in the rotation direction of the sleeve is defined as a third region, magnetic flux density by the magnet member in the first to third regions is the largest in the second region, when a position where the magnetic flux density is the largest in the second region is defined as a reference position, a position where the magnetic flux density is a predetermined value in the second region downstream from the reference position in the rotation direction of the sleeve is defined as a downstream position, and a position where the magnetic flux density is the predetermined value in the third region is defined as an upstream position, a width between the reference position and the upstream position is longer than a width between the reference position and the downstream position, and wherein the magnetic flux density in the first region is smallest at a portion other than a first end of the first region on a side of the second region and a second end of the first region on a side of the third region.

2. The development device according to claim 1, wherein the predetermined value is half of a maximum value of the magnetic flux density in the second region.

3. The development device according to claim 1, wherein a minimum value of the magnetic flux density in the first region is smaller than a maximum value of the magnetic flux density in the second region and smaller than a maximum value of the magnetic flux density in the third region.

4. The development device according to claim 1, wherein a maximum value of the magnetic flux density in the second region is equal to or greater than 40 mT.

5. The development device according to claim 1, wherein a maximum value of the magnetic flux density in the first region is smaller than 40 mT.

6. The development device according to claim 1, wherein:

the surface of the sleeve has a plurality of grooves formed in a direction of a rotation axis of the sleeve, and each of the plurality of grooves has a depth equal to or smaller than 50 μm.

7. An image forming apparatus comprising:

a supply mechanism configured to supply developer;

a developer carrier configured to carry the developer supplied from the supply mechanism, the developer carrier including: a magnet member configured to attract the developer, and a sleeve provided rotatably around the magnet member to convey the developer downstream in a rotation direction; and a restriction member provided to be opposed to a surface of the sleeve, wherein:

when a region on the surface of the sleeve opposed to the restriction member is defined as a first region, a surface region adjacent to the first region and extending to a portion where magnetic flux density is zero downstream in the rotation direction of the sleeve is defined as a second region, and a surface region adjacent to the first region and extending to a portion where magnetic flux density is zero upstream in the rotation direction of the sleeve is defined as a third region, magnetic flux density by the magnet member in the first to third regions is largest in the second region, when a position where the magnetic flux density is largest in the second region is defined as a reference position, a position where the magnetic flux density is a predetermined value in the second region downstream from the reference position in the rotation direction of the sleeve is defined as a downstream position, and a position where the magnetic flux density is the predetermined value in the third region is defined as an upstream position, a width between the reference position and the upstream position is longer than a width between the reference position and the downstream position, and wherein the magnetic flux density in the first region is smallest at a portion other than a first end of the first region on a side of the second region and a second end of the first region on a side of the third region.

8. The image forming apparatus according to claim 7, wherein the predetermined value is half of a maximum value of the magnetic flux density in the second region.

9. The image forming apparatus according to claim 7, wherein a minimum value of the magnetic flux density in the first region is smaller than a maximum value of the magnetic flux density in the second region and smaller than a maximum value of the magnetic flux density in the third region.

10. The image forming apparatus according to claim 7, wherein a maximum value of the magnetic flux density in the second region is equal to or greater than 40 mT.

11. The image forming apparatus according to claim 7, wherein a maximum value of the magnetic flux density in the first region is smaller than 40 mT.

12. The image forming apparatus according to claim 7, wherein:

the surface of the sleeve has a plurality of grooves formed in a direction of a rotation axis of the sleeve, and each of the plurality of grooves has a depth equal to or smaller than 50 μm.

* * * * *